US005409072A

United States Patent [19]

Enlund et al.

[11] Patent Number: 5,409,072

[45] Date of Patent: Apr. 25, 1995

[54] METHOD AND AN ARRANGEMENT FOR CONTROLLING THE SUPPLY OF AIR INTO A ROCK DRILLING MACHINE

[75] Inventors: Pentti Enlund; Kari Tantarimäki, both of Tampere, Finland

[73] Assignee: Tamrock Oy, Tampere, Finland

[21] Appl. No.: 146,131

[22] PCT Filed: May 5, 1992

[86] PCT No.: PCT/FI92/00143

§ 371 Date: Nov. 12, 1993

§ 102(e) Date: Nov. 12, 1993

[87] PCT Pub. No.: WO92/20898

PCT Pub. Date: Nov. 26, 1992

[30] Foreign Application Priority Data

May 23, 1991 [FI] Finland ..... 912510

[51] Int. Cl.[6] ..... E21B 21/08

[52] U.S. Cl. ..... 175/71; 175/296; 175/135; 175/162; 175/212

[58] Field of Search ..... 175/71, 296, 414, 415, 175/135, 162, 212, 24

[56] References Cited

U.S. PATENT DOCUMENTS 4,671,367 6/1987 Brunsing et al. ..... 175/58

FOREIGN PATENT DOCUMENTS 3229487 2/1984 Germany .

*Primary Examiner*—William P. Neuder

*Attorney, Agent, or Firm*—Nixon & Vanderhye

[57] ABSTRACT

A method and an arrangement for controlling the supply of air into a rock drilling machine. In the method, the air supply of an air compressor in a power unit operated by a diesel engine is adjusted so that when the percussion pressure of the percussion device of the rock drilling machine is high, the amount of air supplied by the compressor is small, and vice versa. In the arrangement, the pressure fluid pump of the hydraulic motor of the compressor is an adjustable-displacement pump, the volume flow of the pressure fluid supplied by the pump being adjusted inversely proportionally to the pressure of the supply conduit of the percussion device of the rock drilling machine.

12 Claims, 3 Drawing Sheets

METHOD AND AN ARRANGEMENT FOR CONTROLLING THE SUPPLY OF AIR INTO A ROCK DRILLING MACHINE

The invention relates to a method for adjusting rock drilling when drilling a hole by a rock drilling equipment, wherein a rock drilling machine is operated by a combustion engine operated power unit comprising a hydraulic pump operated by a combustion engine for operating the rock drilling machine, and another hydraulic pump for operating a hydraulic-motor-operated compressor producing flushing air for removing drilling mud from the drill hole, and wherein the pressure of pressure fluid to be supplied to a percussion device of the rock drilling machine is adjusted in response to the drilling conditions.

The invention also relates to an arrangement for realizing the method, comprising a rock drilling machine, a combustion-engine operated power unit having a combustion engine, a hydraulic pump operated by it for operating the rock drilling machine, and another hydraulic pump for operating a hydraulic-motor operated compressor producing flushing air.

To drill earth or rock covered by earth or soft rock material, it is customary to use so-called semi-percussion, that is, the pressure level of the percussion machinery is dropped to a lower level in order to save the drilling equipment and to prevent damage. In diesel-hydraulic or other combustion engine operated equipments, this pressure level drop means that the power output of the motor decreases and thus less fuel is needed. Another typical feature of diesel-hydraulic arrangements is that the same motor rotates both the hydraulic pump(s) of the rock drill and the hydraulic pump of a compressor needed for the production of air required for flushing the drill hole. As the rate of rotation of the diesel engine should be kept substantially constant during operation, the operation of the compressor is not affected in any way although the percussion machinery is operated at half power.

A typical problem with an arrangement operating in the known manner is that when the semi-percussion is applied, the earth or rock material is such that additional air would be required although it is not available. As the maximum power of the diesel engine is constant, a larger compressor for producing air cannot be connected to it without decreasing the power available to the rock drill or having to increase the size and power of the diesel engine to an unreasonably high level in view of the normal operation.

The object of the present invention is to provide a method for controlling the amount of flushing air supplied to a rock drilling machine operated by a combustion-engine operated power unit, by means of which method the amount of air can be increased when the power required by the rock drilling machine is below its maximum power. The method according to the invention is characterized in that the hydraulic pump operating the compressor is an adjustable-displacement pump, the volume flow of the pressure fluid supplied by the adjustable-displacement pump being adjustable by a pressure applied to a control conduit of the pump, and that the volume flow of the pressure fluid supplied by the adjustable-displacement pump is adjusted inversely proportionally to the pressure of the pressure fluid supplied to the percussion device of the rock drilling machine so that when the pressure of the pressure fluid of the percussion device decreases at least to a predetermined pressure below a normal pressure value used in the drilling, the volume flow of the pressure fluid supplied by the pump is increased, so that the rate of rotation of the compressor and thus the amount of air supplied by it increases. The arrangement according to the invention is characterized in that the hydraulic pump operating the compressor is an adjustable-displacement pump, the volume flow of the pressure fluid supplied by the pump being adjustable by a pressure acting on a control conduit of the pump, and that the control conduit of the pump of the compressor is arranged to be controlled by a pressure proportional to the pressure of the pressure conduit of the percussion device of the rock drilling machine so that when the pressure of the pressure conduit of the percussion device decreases at least to a predetermined pressure value, the volume flow of the pressure fluid supplied by the pump increases and thus the rate of rotation of the compressor and correspondingly the amount of air produced by it increase.

The basic idea of the invention is that the pump supplying pressure fluid for rotating the air compressor is an adjustable-displacement pump, by means of which the volume flow of the pressure fluid to the hydraulic motor of the compressor and thus the rotation rate of the motor and the compressor can be adjusted, and that the adjustable-displacement pump is arranged to be controlled by the pressure of the pressure fluid of the percussion device of the rock drilling machine inversely proportionally so that when the percussion pressure drops either to a predetermined limit value or when it deviates constantly from its maximum or minimum value, the volume flow of the pressure fluid supplied by the adjustable-displacement pump is increased, as a result of which the amount of air supplied by the compressor increases, and when the pressures change in the opposite direction, the amount of air supplied by the compressor is decreased when the volume flow of the pressure fluid supplied by the adjustable-displacement pump decreases.

An advantage of the method and the arrangement according to the invention is that when full drilling power cannot be used due to the abundance of earth or the softness of rock, the power saved in the combustion engine, such a diesel engine, due to the reduced power demand of the rock drilling machine can be used for increasing the amount of air, thus promoting the removal of drilling mud from the drill hole. A further advantage is that it is easier to prevent the drill rods from getting stuck in the drill hole so that the successful completion of the drilling is ensured. Still another advantage of the invention is that it enables the use a diesel engine of lower power or of conventional power, as the air supply of the compressor can be adjusted as required, thus fully utilizing the power supplied by the diesel engine in different conditions.

The invention will be described in more detail in the attached drawings, in which FIG. 1 illustrates schematically the control principle according to the invention by means of a percussion device operating at two different power levels;

Figure 1:
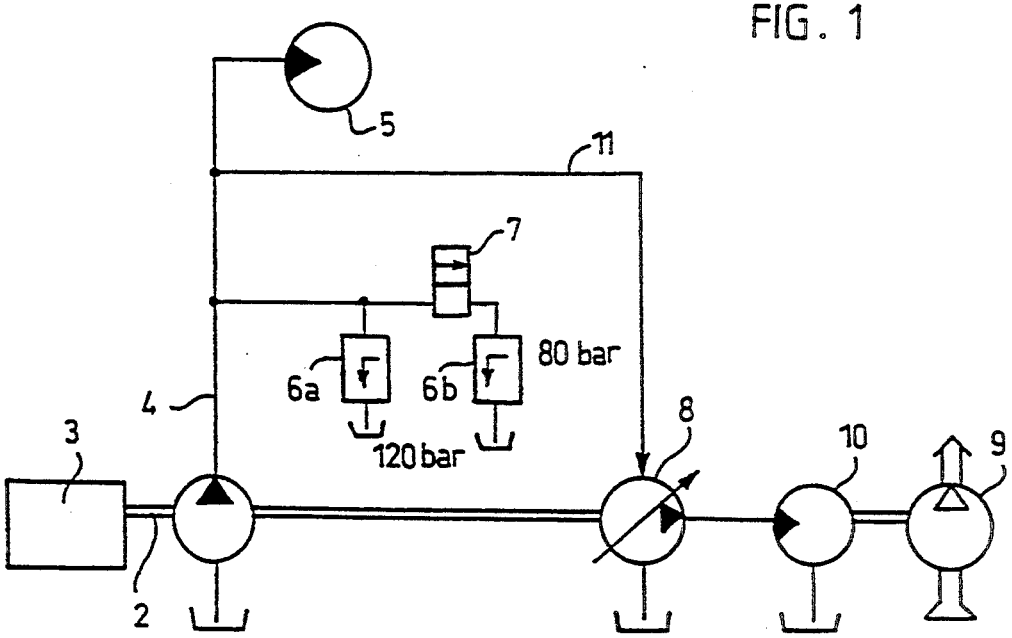

FIG. 1 illustrates schematically a pressure fluid pump 1 rotated in a manner known per se by a combustion engine, such as a diesel engine 3, through a shaft 2. Pressure fluid from the pump 1 is passed through a pressure fluid conduit 4 into a percussion device 5, which is in operation when the pump supplies pressure fluid. Pressure limit switches 6*a* and 6*b* are connected to the pressure conduit 4, that is, the pressure fluid conduit of the percussion device, and a pressure selection switch, i.e. a valve 7 is connected between the pressure limit switches. The motor 3 rotates an adjustable-displacement pump 8 either fixedly through the shaft 2 or otherwise by means of the shaft 2. The volume flow of the pressure fluid supplied by the adjustable-displacement pump 8 is variable and can be controlled. The adjustable-displacement pump 8, in turn, is connected to a rotation motor 10 for a compressor 9, and so the amount of pressure fluid supplied by the pump 8 rotates the motor 10, and a change in the amount of pressure fluid affects the rate of rotation of the motor 10 and the rate of rotation of the compressor 9, as a result of which the amount of air produced by the compressor is also changed. A control conduit 11 branches from the pressure conduit 4 leading to the percussion device 5. The control conduit 11 leads to a control conduit of the adjustable-displacement pump 8, thus controlling the volume flow of pressure fluid supplied by the pump 8. The pressure limit switches 6*a* and 6*b* become operative at different pressure limit values, the pressure value of the switch 6*a* being higher, such as 120 bar, than that of the switch 6*b*, such as 80 bar. When the valve 7 is in the closing position, the limit switch 6*a* having the lower pressure value is inoperative, and so the normal operating pressure (120 bar) is set by the pressure limit switch 6*a*. When the valve 7 is in the connecting position, the pressure limit switch 6*b* having the lower pressure value is operative.

The principal features of the operation shown in the figure will be described below. The details of its parts and the switching principles are shown in FIGS. 2 to 4.

When the engine 3 is in operation, it rotates the pump 1, which supplies pressure fluid to the pressure conduit 4. From the conduit 4 the pressure fluid flows into the percussion device 5, which operates in normal drilling within a predetermined typical operating range, e.g. at a certain pressure value determined by the pressure limit switch 6*a*, when the valve 7 is closed. The switch 6*a* operates in such a way that when the pressure in the conduit 4 increases up to the limit value of the switch 6*a*, such as 120 bar or more, the switch 6*a* allows the flow of pressure fluid through it back into a pressure fluid container so that the pressure value 120 bar is maintained in the conduit 4. If the pressure value starts to decrease, the limit switch 6*a* is closed, and if the pressure value still tends to rise, the limit switch 6*a* opens more so that the pressure is maintained at the desired nominal value, i.e. at the limit value of the switch 6*a*, with a sufficient accuracy. The pressure acting on the pump 8 through the conduit 11 is thus the same as the pressure acting on the percussion device through the conduit 4, and the volume flow of pressure fluid supplied by the pump is adjusted so that the power supplied by the diesel engine 3 is not exceeded. The volume flow is thus such that an air flow produced by the compressor rotated by the motor 10 is sufficient in normal conditions to remove the drilling mud and earth material from the drill hole. When the percussion power and thus the percussion pressure have to be decreased due to the drilling conditions, such as a broken rock or a layer of earth, the valve 7 is positioned in the connected position, so that the pressure limit switch 6*b* having the lower pressure value is connected to control the pressure. In principle, the switch 6*b* operates similarly as the switch 6*a*, and therefore it tends to keep the pressure in the conduit 4 at its own limit value, that is, for instance, at 80 bar. The pressure limit switch 6*a* having the higher pressure limit is closed while the limit switch 6*b* having the lower pressure limit controls the pressure in the conduit 4, admitting more or less pressure fluid into the pressure fluid container, depending on whether the pressure in the conduit 4 tends to rise or drop. Correspondingly, the control pressure acting on the pump 8 through the conduit 4 and the conduit 11 decreases, as a result of which the volume flow of pressure fluid supplied by the pump 8 increases. Consequently, the rate of rotation of the motor 10 increases and thus the rotation rate of the compressor 9 and the amount of air produced by it increase, thus promoting the removal of the drilling mud from the drill hole. As the percussion power of the percussion device 5 decreases, the power demand of the pump 1 is decreased as compared with normal drilling, and so it requires less power from the diesel engine. The power so saved can be utilized for the rotation of the pump 8, as the increase in the volume flow of pressure fluid from the pump 8 requires more power than the normal operation of the pump during normal drilling. An advantage of the arrangement is that when the drilling can be carried out at a low percussion power and more flushing air is usually required than normally, the power saved in the drilling machine and the percussion device can be utilized for the rotation of the compressor and thus for adding the flow of air, and so no overdimensioned compressor or overdimensioned diesel engine is required for this kind of situations.

Figure 2:
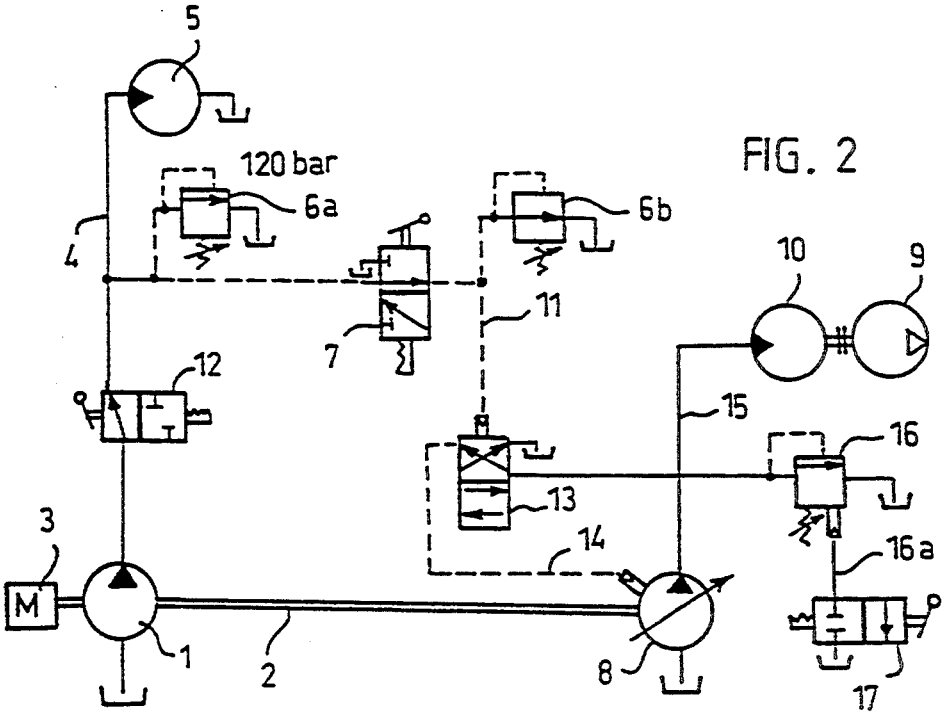
FIG. 2 illustrates schematically a practical embodiment for controlling the air output of the compressor in connection with the percussion device operating on two pressure levels at two different powers.
Figure 3:
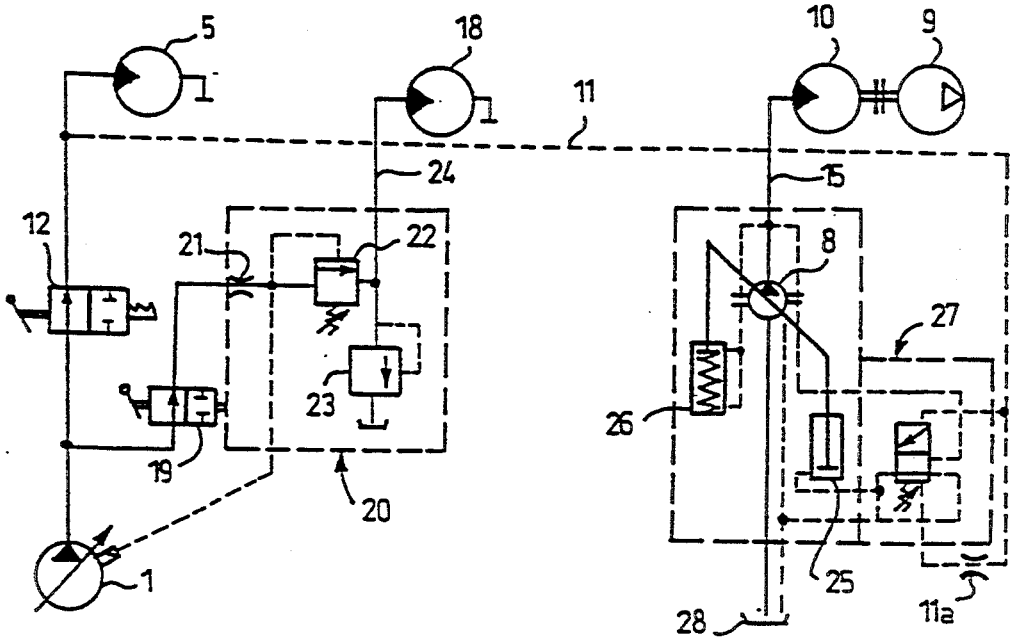
FIG. 3 illustrates schematically a continuous control of the air output of the compressor according to the invention in connection with a continuous pressure level adjustment of the percussion device.

FIG. 2 shows schematically a practical connection for realizing the arrangement of FIG. 1. In FIG. 2, the same reference numerals as in FIG. 1 are used for corresponding components. As compared with the situation shown in FIG. 1, FIG. 2 also shows a regulating valve 12 for switching the percussion device on and off. It further shows a separate control valve 13 fitted in the control conduit 11, from which control valve a separate control conduit 14 leads to the pump 8. The pressure in the conduit 14 is controlled by the valve 13. FIG. 2 also shows a controllable pressure limit switch 16 fitted in a pressure fluid conduit 15 between the pump 8 and the hydraulic motor 10. The pressure limit switch 16 controls the pressure of the fluid acting on the motor 10. Furthermore, a compressor control switch 17 is also fitted in this conduit for switching the compressor on and off by controlling the pressure limit switch 16.

When the valve 12 is in the position shown in FIG. 2, the pressure fluid is able to flow through it, and the percussion device is in operation. Correspondingly, the pressure limit switches 6*a* and 6*b*, which are known per se, adjust the pressure of the pressure fluid in the pressure conduit 4 of the percussion device. In FIG. 2, the selection valve 7 is switched on and the pressure in the conduit 4 acts across the valve 7 on the lower pressure limit switch 6*b*. In the pressure limit switch 6*b* as well as in the pressure limit switch 6*a*, a control conduit leads from the pressure conduit on its inlet side to its spindle, and the pressure forces the spindle against a spring shown in the figure, the spring being adjustable for setting the pressure limit. When the pressure exceeds the preset limit value, the spindle is displaced so that the valve allows the flow of pressure fluid through it into the pressure fluid container, thus maintaining the pressure at the set limit value. The control pressure conduit 11 leads from the valve 6*b* to control the pump 8, which differs from FIG. 1 in that the control conduit 11 in FIG. 1 branches directly from the conduit 4 of the percussion device 5, whereas in FIG. 2 the control conduit is arranged to be controlled by the selection switch 7. In principle, the operation is similar in both cases, and the connection can be made in either way, depending on the selection of the other components and the control connection of the pump 8. When the valve 7 is in the position shown in FIG. 2, the conduit 11 is under pressure, and this pressure has displaced the valve 13 such as shown in the figure, so that the pressure is able to act across the valve 13 from the inlet conduit 15 of the pump 8 into the control conduit 14 of the pump. As a result, the volume flow of pressure fluid caused by the pump 8 is increased even though the rate of rotation of the pump is the same and the rate of rotation of the motor 3 is maintained constant, and so the flow of pressure fluid from the pump 8 to the hydraulic motor and the rate of rotation of the motor 10 are increased. Consequently, the rate of rotation of the compressor 9 and thus the flow of air caused by it are increased. The pressure limit switch 16 fitted in the conduit 15 does not allow the pressure of the pressure fluid to the motor 10 to exceed a predetermined maximum limit value, and the pressure limit switch operates in this sense similarly as the pressure limit switches 6*a* and 6*b*. The pressure limit switch 16 further comprises a separate control conduit 16*a*, which leads to the control switch 17 in the compressor. When the control switch 17 of the compressor is in the position shown in the figure, the conduit 16*a* is closed, and the pressure limit switch 16 operates as a normal pressure limit switch, keeping the pressure in the conduit 15 substantially constant. When the switch 17 is displaced onwards, the conduit 16*a* communicates through it with the pressure fluid container, which releases the pressure limit switch 16 and allows the pressure fluid to flow from the conduit 15 directly into the pressure fluid container, as a result of which the hydraulic motor 10 stops rotating and the compressor stops producing air.

When the percussion pressure selection valve 7 is switched to the lower position shown in FIG. 2, the connection from the conduit 4 to the control conduit 11 is blocked, and the valve 6*b* having the lower pressure limit becomes inoperative. When the pressure drops in the conduit 11, the spindle of the valve 13 is displaced upward in the figure and separates the conduits 15 and 14 from each other, and a pressure drop in the conduit 14 causes a reduction in the volume flow of pressure fluid supplied by the pump 8. The rates of rotation of the motor 10 and the compressor 9 are also reduced with a resultant reduction in the amount of air produced by the compressor 9. At the same time the percussion device 5 start to operate at its normal operating pressure, which is adjusted by the pressure limit switch 6*a*.

FIG. 3 shows schematically an arrangement in which the air supplied by the compressor is adjusted continuously in response to the pressure in the pressure conduit of the percussion device in a structure in which the pressure of the percussion device is adjusted on the basis of the pressure of the feed motor of the drilling machine. The adjustment of the percussion pressure of the drilling machine by means of the pressure of the feed motor as shown in FIG. 3, is described in more detail in Finnish Patent Application No. 891655, and therefore will not be described more closely herein. In FIG. 3, the same reference numerals as above are used for corresponding parts.

In FIG. 3, the pump 1 is an adjustable-displacement pump, and the feed pressure of the pressure fluid of the percussion device 5 is controlled by the pressure of the pressure fluid from a feed motor 18. The equipment further comprises a percussion regulating valve 12 and a feed motor regulating valve 19. Furthermore, it comprises an adjustment unit 20 comprising throttles 21, a pressure ratio regulator 22 and a feed pressure regulator 23. The operation of the hydraulic pump 8 of the compressor is shown schematically in FIG. 3. The hydraulic pump 8 shown more schematically in FIGS. 1 and 2 is similar in structure and operation to that shown in FIG. 3. The figure shows an adjustable-displacement pump 8 operated by the diesel engine 3 comprising a flow adjustment cylinder 25 and a spring-loaded counter cylinder 26. The pump further comprises a pressure-controlled proportional regulating valve 27. The pump 8 sucks pressure fluid from a pressure fluid container 28 and feeds it further into the pressure conduit 15. The pressure conduit 15 feeds pressure fluid into the hydraulic motor 10 of the compressor 9, which is known per se, and will not be described in more detail in this connection. Pressure fluid returning from the hydraulic motor 10 is passed back into the pressure fluid container 28. If the conditions remain constant all the time, that is, the pressure in the feed conduit 4 of the percussion device remains constant, the pressure in the control conduit 11 also remains constant and the operation of the pump 8 is thus not controlled from outside it. The flow adjustment cylinder 25 and the spring-loaded counter cylinder 26, which are normal components of the pump 8, keep the volume flow of the pump 8 automatically such that the pressure of the pressure conduit 15 remains constant. The structure and operation of the pump 8 and its integral components are known per se and will not be described in more detail herein.

During drilling, when the drill bit hits e.g. soft rock, a hole, a hollow, or the like, the force resisting the feed and thus the pressure prevailing at the feed motor 18 drops, and so the percussion pressure of the percussion device 5 drops rapidly with the feed pressure. In this way an excessive percussion power with respect to the feed and its resultant conversion into heat will not occur. Correspondingly, when the pressure drops, the pressure in the control conduit 11 also drops and increases the volume flow of pressure fluid supplied by the pump 8 by means of the regulating valve 27. When the drill bit again hits normal rock or rock surface, the pressure on the outlet side of the feed motor 18 increases again, and, correspondingly, the pressure in the pressure conduit 4 of the percussion device 5 increases, as a result of which the pressure in the control valve 26 of the pump 8 increases and the volume flow supplied by the pump 8 is decreased. The control conduit 11 extending from the pressure conduit 4 of the percussion device is further connected through a throttle 11a to one end of the spindle of the valve 27, so that it dampens and smooths the movements of the spindle during abrupt pressure changes.

In the operation of the percussion device 5 and the adjustable-displacement pump 1 of the feed apparatus 18, the percussion device 5 can be switched on by means of the valve 12, which admits pressure fluid into the percussion device or does not admit, depending on its position. Correspondingly, it is possible to control the feed of pressure fluid by means of the feed valve 19 to the feed motor 18, depending on its position. In FIG. 3, the valves 12 and 19 are so positioned that the percussion device 5 and the feed apparatus 18 are in operation. From the pressure conduit of the percussion device the conduit 11 leads to the regulating valve 27 of the pump 8. From the pressure conduit of the percussion device 5, a conduit leads into the valve unit 20, in which it first enters the throttle 21 and then passes to the feed motor through the percussion and feed pressure ratio regulator 22. A feed pressure regulator 23 is connected to the outlet conduit of the pressure ratio regulator 22 so as to adjust the pressure of a conduit 24 to the feed motor.

In this arrangement the pressure in the pressure conduit to the percussion device 5 is adjusted by means of the pressure acting in the pressure fluid supply conduit 24. As is disclosed in the above-mentioned Finnish Patent Application, the combined effect of the throttle 21 and the regulator 22 keeps the pressure conduit of the percussion device 5 in a linear relationship with the pressure conduit 24 of the feed motor 18. When the resistance of the feed motor 18 is decreased, the pressure in its conduit 24 drops and, correspondingly, the pressure of the pressure fluid of the percussion device 5 in the conduit 4 drops when the valve 22 and the throttle 21 control the adjustable-displacement pump as described in the above-mentioned Finnish Patent Application. The pressure of the percussion device 5 thereby controls the adjustable-displacement pump 8 of the compressor 9 inversely proportionally so that the volume flow of the pump 8 decreases with increasing percussion pressure, and so the rate of rotation of the compressor and the amount of air produced by it decrease. Correspondingly, the volume flow of fluid supplied by the adjustable-displacement pump 8 increases with decreasing pressure of the percussion motor 5, and the rate of rotation of the motor 10 of the compressor 9 and thus also the flow of air produced by the compressor increase. In this way the power of the diesel engine can be utilized efficiently during drilling so that on drilling hard rock in favourable conditions and with a low demand or air, the amount of air produced by the compressor is small, and when the conditions get worse and one has to drill through earth or a layer of earth, the percussion power remains low and substantially all of the saved power of the diesel engine is used for increasing the amount of air supplied by the compressor, so that a great amount of drilling mud can be removed out of the drill hole, and the drilling equipment is prevented from getting stuck. The maximum pressure prevailing in the feed conduit 24 of the feed apparatus can be adjusted by the pressure limit switch 23, so that the maximum feed power can be limited by means of it when the device operates otherwise in response to the load. As far as the feed resistance is low enough, the pressure in the conduit 24 remains below the set value of the pressure limit switch 23, and the feed pressure of the feed motor varies with the load.

Figure 4A:
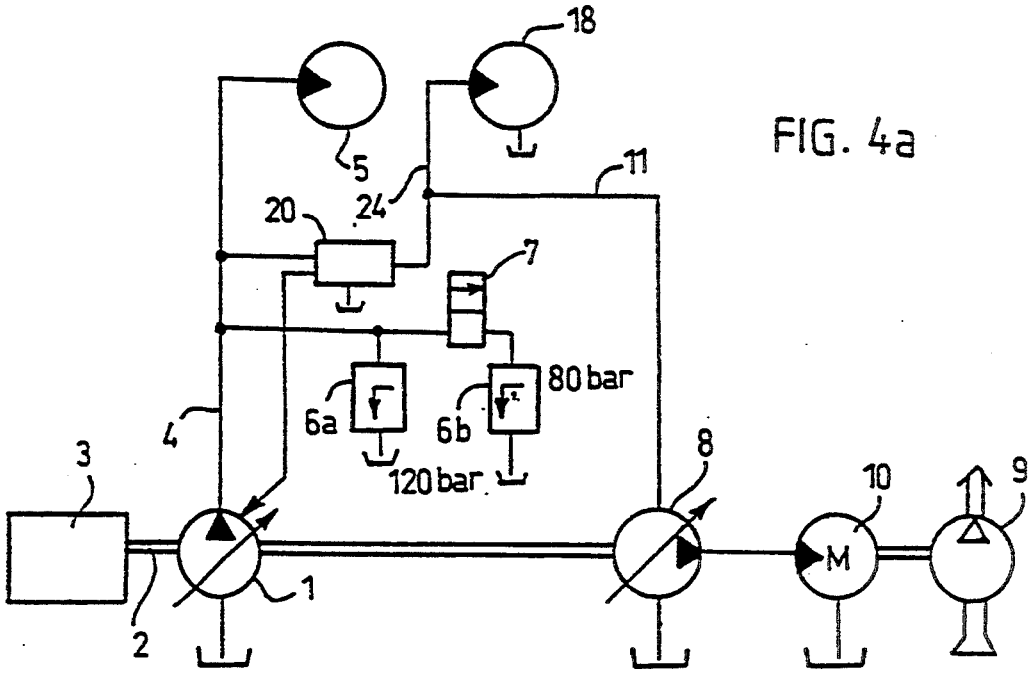
FIGS. 4*a* to 4*b* illustrate schematically the adjustment of the air output of the compressor continuously under the control of another pressure controlling the percussion pressure.
Figure 4B:
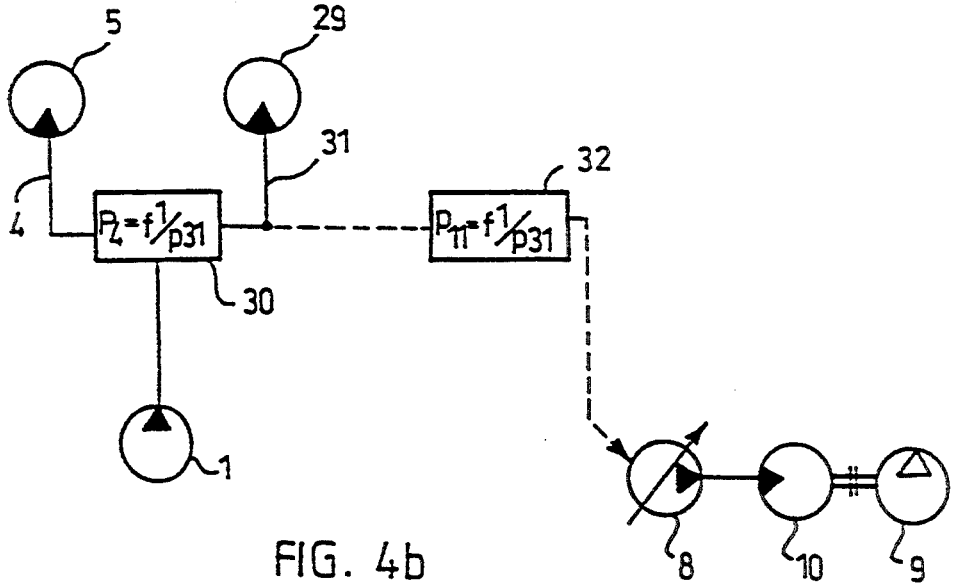

FIGS. 4*a* and 4*b* illustrate other applicable ways of adjustment in which the air supply of the compressor is adjusted indirectly in proportion to the percussion pressure of the percussion device, using some other pressure value as an adjustment parameter, which is either directly or inversely proportional to the percussion pressure of the percussion motor.

FIG. 4*a* shows schematically a connection in which the adjustable-displacement pump 8 of the compressor 9 is controlled by the pressure supply conduit of the feed motor. The connection of FIG. 4*a* is, in principle, similar to and operates similarly as that shown in FIG. 3, but the control conduit 11 of the pump 8 is connected to the supply conduit 24 of the feed motor 18 in place of the supply conduit 4 of the percussion device 5. As the pressure of the percussion device 5 is substantially in direct ratio to the pressure of the feed apparatus, its adjustment is proportional to the pressure of the pressure fluid of the percussion device.

FIG. 4*b* shows schematically a connection in which the pressure of the percussion device 5 is controlled by the pressure of the rotation motor 29 by means of a regulator or a hydraulic connection 30, so that when the pressure of the pressure fluid increases in the supply conduit 31 of the rotation motor 29, the pressure in the supply conduit 4 of the percussion device 5 decreases. The adjustment of the percussion pressure of the percussion device of the drilling machine on the basis of the pressure of the rotation motor is known per se e.g. from Finnish Patent 55892. In this embodiment of the invention, it is possible to use the arrangement disclosed in the above-mentioned Finnish Patent or French Patent 2129276, or any other known arrangement, in which the percussion pressure is adjusted inversely proportionally to the pressure of the pressure conduit of the rotation motor. In the arrangement shown in FIG. 4*b*, the control conduit 11 of the adjustable-displacement pump 8 of the compressor 9 is connected to the supply conduit 31 of the rotation motor 30 by a regulator or a hydraulic connection 32. As the pressure increases in the pressure conduit 31 of the rotation motor 30, it causes the pressure in the pressure conduit of the percussion device 5 to decrease. Correspondingly, the pressure in the control conduit 11 connected to the supply conduit 31 of the rotation motor by the regulator 32 decreases and causes the volume flow of the pump 8 to increase so that the amount of air supplied by the compressor 9 increases when the rate of rotation of the compressor is increased, as already described above. In the arrangement shown in FIG. 4*b*, it is, of course, possible to connect the control conduit 11 directly to the pressure conduit 4 of the percussion device 5 even though the percussion adjustment takes place on the basis of the adjustment of the pressure conduit of the rotation motor.

The invention has been described in the above description and in the attached drawings only by way of example, and it is in no way restricted to this example. The invention can be applied widely within the scope defined in the attached claims. Essential is that the air supply of the air compressor included in the power unit operated by the diesel engine or other combustion engine is adjusted inversely proportionally to the pressure of the percussion device of the drilling device so that when the pressure of the percussion device is high, the air supply is low; correspondingly, when the pressure of the percussion device is low, the air supply of the compressor is high. In the preferred embodiment, the pressure fluid pump of the hydraulic motor of the compressor rotated by the diesel engine is an adjustable-displacement pump, so that when the rate of rotation of the diesel engine is substantially constant, the volume flow of the pressure fluid supplied by the pump of the compressor motor is adjusted inversely proportionally to the percussion pressure either stepwise or continuously. The basic idea of the invention can be applied by using adjustable-displacement pumps which are adjusted in different ways and various connections for identifying the pressures and for connecting the control pressure to the adjustable-displacement pump. The figures and the description do not mention various well-known regulating and control valves and shut-off valves and the like, by means of which the operation of the device can be controlled and protected in other ways, as they are not essential to the invention. The use or omission of such regulating, control and protection connections do not in any way restrict the invention nor limit its scope of protection. The adjustable-displacement pump, which supplies pressure fluid to the hydraulic motor of the compressor may be controlled in various ways, so that the volume flow may increase with increasing or decreasing pressure to realize a desired connection. Also, various pressure reversing connections and components can be connected in a suitable way to achieve a desired operation.

We claim:

1. A method for adjusting rock drilling when drilling a hole by a rock drilling equipment, wherein a rock drilling machine is operated by a combustion-engine-operated power unit comprising a first hydraulic pump operated by a combustion engine for operating the rock drilling machine, and a second hydraulic pump for operating a hydraulic-motor-operated compressor producing flushing air for removing drilling mud from the drill hole, and wherein the pressure of pressure fluid to be supplied to a percussion device of the rock drilling machine is adjusted in response to the drilling conditions, comprising the steps of:

providing an adjustable displacement hydraulic pump for operating the compressor;

applying in a control conduit a controlling pressure for the pump;

adjusting the volume flow of the pressure fluid supplied by the adjustable-displacement hydraulic pump to the compressor by controlling the pressure in the control conduit for the pump in a manner inversely proportionally to the pressure of the pressure fluid supplied to the percussion device of the rock drilling machine so that when the pressure of the pressure fluid of the percussion device decreases at least to a predetermined pressure below a pressure value used for normal drilling, the volume flow of the pressure fluid supplied by the pump is increased, such that the rate of rotation of the compressor and the amount of air supplied by said compressor increases.

2. A method according to claim 1 including directly adjusting the volume flow of the pressure fluid supplied by the hydraulic pump to the compressor in response to the pressure of the pressure fluid supplied the percussion device.

3. A method according to claim 1 including indirectly adjusting the volume flow of the pressure fluid supplied by the pump to the compressor as a function of a pressure proportional to the pressure of the pressure fluid supplied the percussion device.

4. A method according to claim 3 including adjusting the volume flow of the hydraulic pump as an inverse function of the pressure of a supply conduit for a feed motor of the rock drilling machine and adjusting the percussion pressure of the percussion device of the rock drilling machine in direct proportion to the feed pressure of the feed motor.

5. A method according to claim 3 including adjusting the volume flow of the hydraulic pump of the compressor on the basis of the pressure of a supply conduit for a rotation motor of the rock drilling machine so that the volume flow of the hydraulic pump of the compressor increases with the pressure of the supply conduit of the rotation motor and simultaneously adjusting the pressure of the pressure fluid supplied to the percussion device of the rock drilling machine as an inverse function of the pressure of the supply conduit of the rotation motor so that when the pressure of the supply conduit of the rotation motor increases, the pressure of the pressure fluid to be supplied to the percussion device decreases, and vice versa.

6. A method according to claim 1 including adjusting the volume flow of the hydraulic pump of the compressor substantially continuously and in inverse proportion to the pressure of the percussion device.

7. An arrangement for controlling a supply of air to a rock drilling machine, comprising:

a combustion-engine-operated power unit having a combustion engine, a first hydraulic pump coupled to said combustion engine for operating the rock drilling machine, said rock drilling machine including a percussion device having a pressure conduit;

a second adjustable displacement hydraulic pump for operating a hydraulic-motor-operated compressor producing flushing air, said second pump having a control conduit for controlling the second pump;

means for adjusting the volume flow of the pressure fluid supplied by said pump by applying a control pressure to the control conduit of the pump proportional to the pressure of said pressure conduit of said percussion device such that, when the pressure of said pressure conduit decreases at least to a predetermined pressure value, the volume flow of the pressure fluid supplied by said pump increases and the rate of rotation of the compressor and correspondingly the amount of air produced thereby increases.

8. An arrangement according to claim 7 including two pressure limit switches having different pressure values and connected to said pressure conduit of the percussion device to control its pressure, the pressure limit switch set to a higher pressure value being operative at a normal operating pressure of said percussion device and a valve for connecting and disconnecting the pressure limit switch set to a lower pressure value relative to said pressure conduit of said percussion device, said control conduit of said pump being connected to a pressure conduit of the pressure limit switch set to the lower pressure value, so that when it is connected to the pressure conduit of the percussion device, the pressure prevailing in it is lower and the pressure prevailing in the pressure conduit of the percussion device adjusts the pump of the compressor so that the volume flow of pressure fluid supplied by it to a motor for the compressor increases.

9. An arrangement according to claim 7 wherein said control conduit of said second pump is controlled continuously by a pressure proportional to the pressure of said pressure conduit of the percussion device.

10. An arrangement according to claim 7 wherein said control conduit is connected directly to said pressure conduit.

11. An arrangement according to claim 7 including a feed motor and a second pressure conduit connected to said feed motor, said pressure conduit of the percussion device being connected to said second pressure conduit of the feed motor, said control conduit of the pump of the compressor being connected to said second pressure conduit of the feed motor.

12. An arrangement according to claim 7 including a rotation motor and a third pressure conduit coupled to said rotation motor, the pressure conduit of the percussion device being connected to said third pressure conduit of the rotation motor such that the pressure is inversely proportional to it, said control conduit of the pump of the compressor being connected to said third pressure conduit of the rotation motor.

* * * * *